US005740264A

United States Patent [19]

Kojima

[11] Patent Number: 5,740,264

[45] Date of Patent: Apr. 14, 1998

[54] MINIATURE ELECTROACOUSTIC TRANSDUCER

[75] Inventor: Koichi Kojima, Akishima, Japan

[73] Assignee: Foster Electric Co., Ltd., Tokyo, Japan

[21] Appl. No.: 698,087

[22] Filed: Aug. 15, 1996

[30] Foreign Application Priority Data

Aug. 29, 1995 [JP] Japan ..... 7-243710

[51] Int. Cl.[6] ..... H04R 25/00

[52] U.S. Cl. ..... 381/193; 381/199; 381/205; 181/171; 181/172; 181/173

[58] Field of Search ..... 381/196, 202, 381/203, 193, 205, 188; 181/157, 167, 169, 171, 172, 173

[56] References Cited

U.S. PATENT DOCUMENTS

| | | | |
|---|---|---|---|
| 4,273,968 | 6/1981 | Suyama | 381/203 |
| 5,003,610 | 3/1991 | Adachi et al. | 381/203 |
| 5,251,188 | 10/1993 | Parsons et al. | 381/193 |

FOREIGN PATENT DOCUMENTS

| | | | |
|---|---|---|---|
| 0183463 | 10/1955 | Germany | 381/203 |
| 0171399 | 9/1984 | Japan | 381/203 |
| 59-159097 | 10/1984 | Japan . | |
| 0247699 | 10/1987 | Japan | 381/203 |
| 5-115099 | 5/1993 | Japan | 381/193 |
| 5-328489 | 12/1993 | Japan | 381/193 |
| 7-15792 | 1/1995 | Japan . | |
| 7-46690 | 2/1995 | Japan . | |

*Primary Examiner*—Curtis Kuntz
*Assistant Examiner*—Rexford N. Barnie

[57] ABSTRACT

An electroacoustic transducer has a diaphragm body including a planar diaphragm having an outer periphery in an elongated generally elliptical shape with semicircular ends and major and minor axes, and an elastometic edge having an outer periphery of an elongated generally elliptical shape with semicircular ends and major and minor axes aligned with the major and minor axis of the diaphragm, the edge being wider along the major axis than along the minor axis and coupled at an inner periphery to the outer periphery of the diaphragm. The edge has a concave cross-section perpendicular to the diaphragm. A cylindrical voice coil bobbin is secured at one end to a central area of the diaphragm, and a voice coil is wound on the voice coil bobbin. A molded resin frame having a generally rectangular shape includes an opening conforming in shape to and receiving the diaphragm body, and is connected to and supports an outer periphery of the edge. The frame includes a central base containing a magnetic circuit for driving the diaphragm in response to an electrical signal applied to the voice coil.

8 Claims, 5 Drawing Sheets

MINIATURE ELECTROACOUSTIC TRANSDUCER

BACKGROUND OF THE INVENTION

This invention relates to miniature electroacoustic transducers and, more particularly, to a miniature electroacoustic transducer effectively employable as incorporated into a narrow mounting space of rectangular or like shape in the interior of such associated devices as small or miniature personal computers, portable radios, tape recorders and so on.

DESCRIPTION OF RELATED ART

In personal computers and the like, in general, there have been incorporated such miniature electroacoustic transducers as loudspeakers, and mounting spaces for such transducers are immediately subjected to a restriction when a sufficient dimensional minimization is intended.

The mounting spaces have been normally of rectangular shape and narrow, whereas the loudspeakers of circular shape have been employed, so that the employable loudspeaker in respect of the rectangular mounting space is limited to one having a diameter corresponding to the width of the space, the effective vibration area of the diaphragm is eventually limited to be small, and it has not been easy to realize high quality acoustic characteristics in the devices. In order to elevate the acoustic characteristics of the devices, on the other hand, it has been suggested to employ two of the circular miniature loudspeakers in each rectangular space, but this still has been troublesome because of complicated mounting work due to the narrowness of the mounting space, and of the cost of two loudspeakers.

In Japanese Utility Model Laid-Open Publication No. 59-159097, Japanese Patent Laid-Open Publications Nos. 7-46690 and 7-15792, on the other hand, there have been disclosed diaphragm arrangements having an elliptic outline, but their object is only to reduce acoustic distortion due to the formation of the diaphragm body in an elliptic shape by varying the stiffness of edge portion joined to the diaphragm body between the major axis side and minor axis side of the edge portion. The speakers do not provide any elliptic, planar diaphragm of a tone quality suitable for use as a music source nor show any unique arrangement in respect of the edge portion.

SUMMARY OF THE INVENTION

Thus a main object of the present invention is to provide a miniature electroacoustic transducer which is capable of eliminating the foregoing problems of known transducers, being effectively disposed in a mounting space of rectangular or like shape, attaining tone quality suitable for use as a music source by a single electroacoustic transducer itself, and effectively realizing an excellent space factor while maintaining excellent characteristics and easy mountability with high economy.

According to the present invention, the above object can be realized by means of a miniature electroacoustic transducer in which a diaphragm body is mounted on a frame formed with a molded resin through positioning guides provided at respective diagonal corners, and the diaphragm body comprises a diaphragm and an edge disposed peripherally around the diaphragm, characterized in that the frame is formed in an elliptic shape, and the diaphragm of the diaphragm body is provided in an elliptic and planar shape.

Other objects and advantages of the present invention shall become clear as the following description of the invention advances as detailed with reference to a preferred embodiment shown in accompanying drawings.

While the present invention shall now be described with reference to the specific embodiment shown, it should be appreciated that its intention is not to limit the present invention only to the specific embodiment but rather to include all alterations, substitutions and equivalent arrangements possible within the scope of appended claims.

DETAILED DESCRIPTION OF THE PREFERRED EMBODIMENT

Referring to FIGS. 1–4, a miniature electroacoustic transducer 10 according to the present invention includes a frame 11, injection molded of a resin such as acrylonitrile-butadiene-styrene (ABS). This frame 11 is provided in a rectangular shape substantially corresponding to the shape of the mounting space, and is dimensioned to be, for example, 40 mm long, 20 mm wide and 8.5 mm high. By forming the frame 11 in a rectangular shape, the transducer effectively utilized the limited mounting space. Therefore, any wasted space can be well reduced according to the present invention, while a frame formed in circular shape, for example, causes wasted space on the side of the set. Further, in contrast to a loudspeaker employing a circular frame of the same size in the widthwise and lengthwise directions, the diaphragm employing the rectangular frame can have a larger effective vibration area, so as to be provided with higher quality characteristics. On this frame 11, further, there is provided a planar type diaphragm body 12 in an elliptic shape as a whole. In four corner portions of the frame 11, there are provided mounting through holes a.

Figure 5:
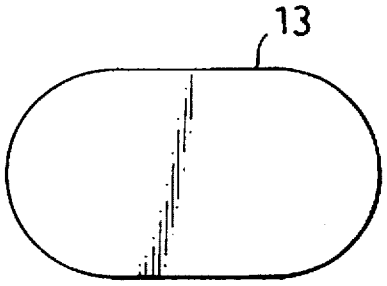
FIG. 5 shows in a plan view the diaphragm employed in the transducer of FIG. 1.
Figure 6:
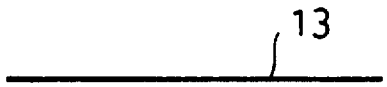
FIG. 6 is a side elevation of the diaphragm of FIG. 5.

More specifically, also by references to FIGS. 5 and 6, the diaphragm body 12 is mainly constituted by a diaphragm 13, which is formed in a very thin planar shape with a foamed mica molded, so that the miniature electroacoustic transducer will be reduced in height. In respect of the formation of the diaphragm 13 with the foamed mica, details have been described in U.S. Pat. No. 5,003,610 of the same assignee as the present invention. Just as an example, the foamed mica may be attained by obtaining from natural mica scale-like flakes through underwater releasing, blending a proper amount of pulp fibers, polyvinyl alcohol (PVA) fibers or the like with the mica flakes, obtaining through wet paper making a water-containing sheet, and subjecting the water-containing sheet to an expansion molding under heat.

When, in this case, a film diaphragm of an inverse dome-shape or dome-shape is employed as in ordinary miniature electroacoustic transducer, an excessive space is required, which increases the whole height, but the use of the planar foamed mica diaphragm as in the present invention enables the whole height to be minimized as much as possible. In this case, further, the formation of the diaphragm in a planar shape is effective to expand the flat f characteristics over a wider range and contributes to an improvement in the tone quality. That is, with the dome-shaped diaphragm, the characteristics may be expanded to the higher range but there arises a tendency that the sound pressure rises in the higher range, and it becomes difficult to obtain flat characteristics.

Figure 7:
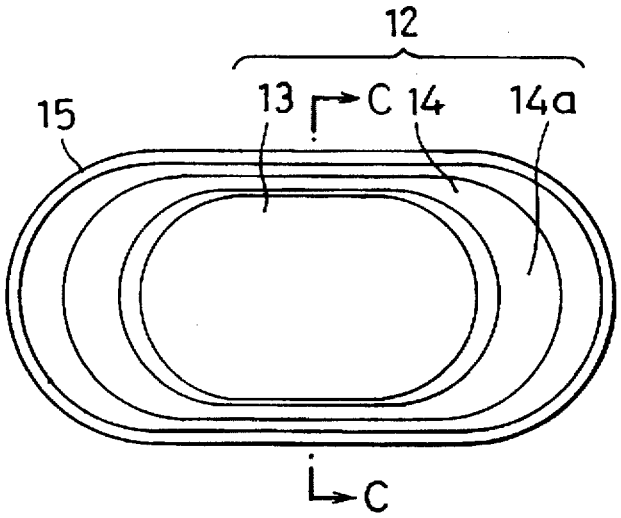
FIG. 7 shows in a plan view the diaphragm body including the diaphragm and edge and employed in the transducer of FIG. 1.
Figure 8:
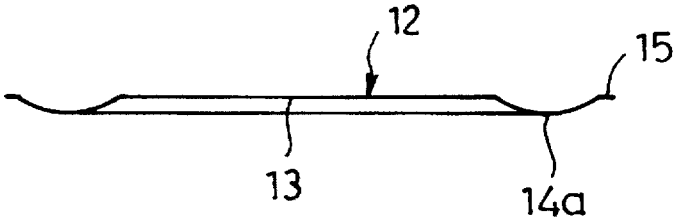
FIG. 8 is a side elevation of the diaphragm body of FIG. 7.
Figure 9:
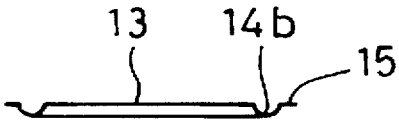
FIG. 9 is a sectioned view taken along line 9—9 in FIG. 7 of the diaphragm body.

This planar diaphragm 13 formed by the very thin foamed mica is provided peripherally with an edge 14, as will be clear in particular from FIGS. 7–9. This edge 14 and the foregoing planar diaphragm 13 made of the foamed mica are integral with each other. This edge 14 is formed of a urethane ester elastomer. Using this urethane ester elastomer, it is possible to render the molding properties in the aspect of excellent manufacturing and any configurational fluctuation can be minimized. That is, while the edge of ordinary film or the like is apt to fluctuate in the $f_0$ or f characteristics depending on the molded state, such fluctuation can be prevented from occurring by using an urethane ester elastomer.

Further, with the use of such edge 14 formed by urethane ester elastomer flexibility is sufficiently increased to ensure the required compliance for the edge even in a case where a sufficient width cannot be attained as the minor axis side of the elliptical shape, and to reduce any disturbance to the amplitude of voice coil vibration even in the case of abruptly rising R. Consequently, this edge 14 is capable of coping with a large amplitude of the diaphragm and also lowering $f_0$. It is also possible to prevent any abnormal noise due to deformation or the like from occurring. In other words, the film-made diaphragm is unable to absorb any distortion when the amplitude grows large and is apt to generate abnormal noise and $f_0$ is apt to remarkably rise due to abrupt slopes involved. However, these problems can be overcome by forming the edge 14 with a polyurethane ester sheet.

The edge 14 includes, as seen in particular in FIG. 8, curved portions **14*a* gradually bending downward on both major axis sides. As seem further in FIG. 7, the edge 14 is narrow in the minor axis directions and wide in the major axis directions so as to be substantially elliptical, and is provided along a peripheral edge with such mounting part 15 as a guide ring or a gasket. The diaphragm body 12 is mounted onto the frame 11 as supported at four points by means of guides 16 at four corners, through an adhesive, in a state in which the diaphragm body 12 is surrounded by the mounting part 15. At this time, as seen in FIG. 9, edge slopes 14*b*** are formed in the minor axis directions.

The guides 16 are provided at the four corner portions of the frame 11 for positioning the diaphragm. To these guides 16, outer arcuate edges of the mounting part 15 of the diaphragm body 12 comprising the diaphragm 13 and edge 14 are engaged for the mounting. No guide is provided at respective sides on the major axis and minor axis directions, keep the vibration area larger.

Figure 1:
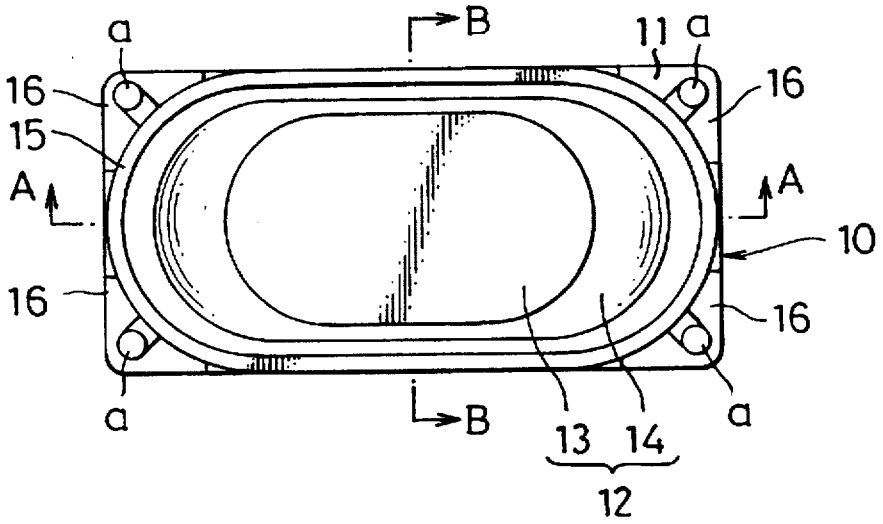
FIG. 1 is a plan view of the miniature electroacoustic transducer according to the present invention.
Figure 2:
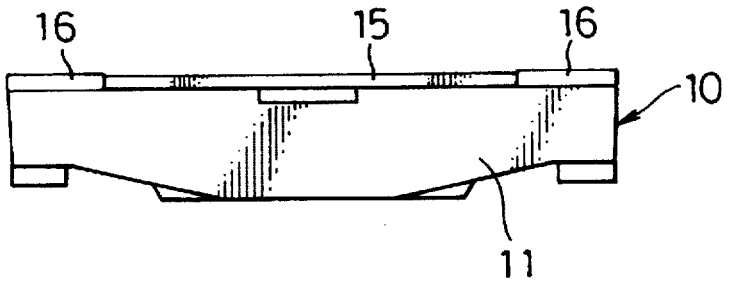
FIG. 2 is a side elevation of the transducer of FIG. 1.
Figure 3:
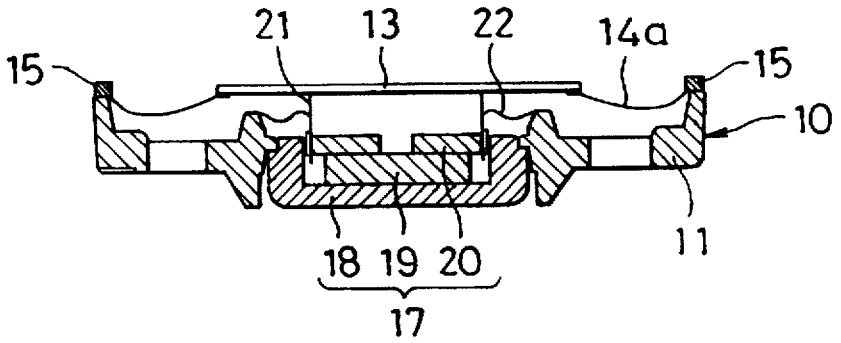
FIG. 3 is a sectioned view taken along line 3—3 in FIG. 1 of the transducer.
Figure 4:
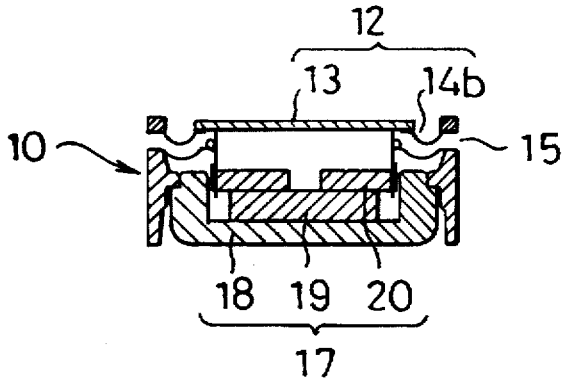
FIG. 4 is a sectioned view taken along line 4—4 in FIG. 1 of the transducer.

Further, the frame 11 is constituted, as shown in FIG. 3 in particular, for an insert molding or an incorporation of a magnetic circuit positioned on the lower side. That is, the frame 11 is provided with an inner magnet or core type magnetic circuit 17. When, in this case, an outer magnet or a shell type is adopted, the configuration is enlarged, and flux leakage occurs adversely affecting computers or the like. This problem can be eliminated by employing an inner magnet or core. The magnetic circuit 17 is constituted by a yoke 18 substantially of U-shape in section, a magnet 19 provided in the bottom of the yoke 18, and a plate 20 placed on the magnet 19. A voice coil carried at the lower end of a cylindrical bobbin 21 is disposed in a magnetic gap between the outer periphery of the plate 20 and the upper inner periphery of the yoke 18 opposing the plate 20.

While in the magnetic circuit described includes an inner magnet or core, it is possible to employ the magnetic circuit including the outer magnet or shell type depending on the application (in another use than the computer), and the outer magnet or shell type will be more advantageous from the view point of the sound pressure.

Figure 10:
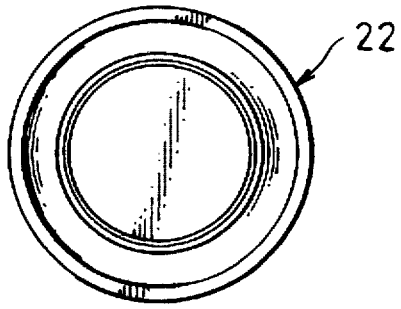
FIG. 10 shows in a plan view a damper for the diaphragm employed in the transducer of FIG. 1.
Figure 11:
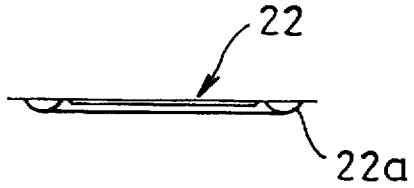
FIG. 11 is a side view of the damper of FIG. 10.

The top of the cylindrical voice coil bobbin 21 carrying the voice coil is adhered directly to the diaphragm 13. Further, this voice coil bobbin 21 is supported by a damper 22 which is, as shown in FIGS. 10 and 11, formed in a short cylindrical shape, provided on outer periphery with a corrugation **22*a*, adhered on the inner periphery to the voice coil bobbin 21, and also adhered on the outer periphery to a damper support part of the frame 11, as shown particularly in FIG. 3**.

Figure 12:
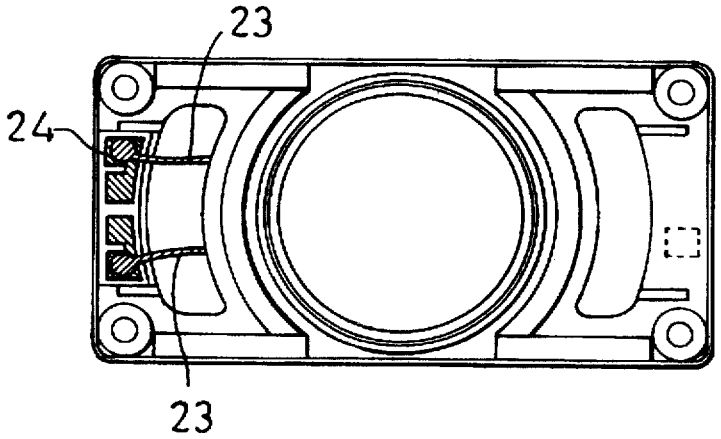
FIG. 12 is a bottom view of the miniature electroacoustic transducer of FIG. 1.

Referring also to FIG. 12, on the backside of the miniature electroacoustic transducer 10 of the present invention, there are provided tinsel cords 23 connected at one end to the voice coil and at the other end to a terminal base 24 on one major axis side of the rectangular frame 11. By forming thus the voice coil and the tinsel cord system, the arrangement is made simpler and can attain a high withstand input. In other words, an arrangement in which coil lead wires are laid, it is required to perform a damping or the like treatment, but the present invention renders this unnecessary.

Figure 13:
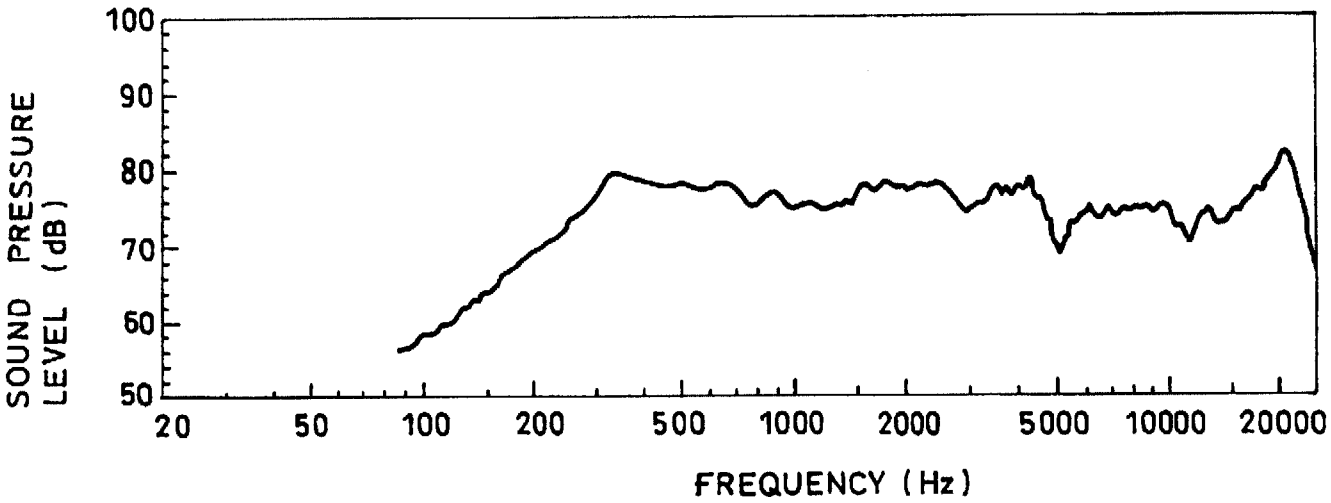
FIG. 13 is a diagram showing the frequency characteristics with respect to the sound pressure level of the miniature electroacoustic transducer of FIG. 1.

Since the miniature electroacoustic transducer 10 of the present invention arranged as has been described above is formed in rectangular shape, and the diaphragm 13 of planar foamed mica is mounted to the frame 11 through the edge 14 of urethane ester elastomer, it is possible to attain such f characteristics as shown in FIG. 13, which are made constant from the lower range to the higher range of the frequency with a simpler and inexpensive arrangement. Further, as the guides 16 are provided at diagonal corners of the frame 11 and the mounting part 15 cooperating with the guides 16 is provided on the diaphragm body 12, the arrangement has remarkably high workability.

It should be readily appreciated that the miniature electroacoustic transducer 10 of the foregoing arrangement is applicable not only to the personal computers including desktop, notebook, or the like, but also to such miniature electronic devices and equipments as speaker-microphones for use in communication devices and equipment, miniature radios, vehicle-use miniature televisions of employing liquid crystal display, navigation systems, and which attach importance to the tone quality to some extent.

What is claimed is:

1. An electroacoustic transducer comprising:

a diaphragm body including:

a planar diaphragm having an outer periphery in an elongated generally elliptical shape with semicircular ends and major and minor axes, an elastometic edge having an outer periphery in an elongated generally elliptical shape with semicircular ends and major and minor axes aligned with the major and minor axis of the diaphragm, respectively, the edge being narrower parallel to the major axis than parallel to the minor axis, the edge being coupled at an inner periphery to the outer periphery of the diaphragm and having a concave cross-section perpendicular to the diaphragm, a cylindrical voice coil bobbin secured at one end to a central area of the diaphragm, and a voice coil wound on the voice coil bobbin; and a molded resin frame having a generally rectangular shape and including an opening conforming in shape to and receiving the diaphragm body, connected to and supporting an outer periphery of the edge, the frame including a central base containing a magnetic circuit for driving the diaphragm in response to an electrical signal applied to the voice coil.

2. The transducer according to claim 1 wherein the magnetic circuit is an inner magnetic circuit.

3. The transducer according to claim 1 wherein the magnetic circuit is an inner core circuit.

4. The transducer according to claim 1 wherein the frame includes four corners, each corner including a guide for positioning the diaphragm body in the frame.

5. The transducer according to claim 1 wherein the elongated generally elliptical shape of the diaphragm includes two parallel sides, parallel to the major axis, and the two semicircular ends that connect the two parallel sides.

6. The transducer according to claim 1 wherein the diaphragm body is foamed mica.

7. The transducer according to claim 1 wherein the edge is a urethane ester elastomer.

8. The transducer according to claim 1 including an annular damper secured at an outer periphery to the frame and at an inner periphery to the voice coil bobbin.

* * * * *